United States Patent [19]

Roethke

[11] Patent Number: 4,635,934

[45] Date of Patent: Jan. 13, 1987

[54] EXERCISE TOWER AND BENCH

[76] Inventor: Siegfried Roethke, Kiefernweg 19, 3172 Isenbuettel-Tankumsee, Fed. Rep. of Germany

[21] Appl. No.: 760,049

[22] Filed: Jul. 29, 1985

[51] Int. Cl.[4] ..... A63B 17/00

[52] U.S. Cl. ..... 272/144; 272/134; 272/117; 272/123

[58] Field of Search ..... 272/116, 117, 118, 123, 272/134, 144; 128/70–74; 269/325

[56] References Cited

U.S. PATENT DOCUMENTS

| | | | |
|---|---|---|---|
| 2,283,475 | 5/1942 | Wagner | 272/134 X |
| 2,944,592 | 7/1960 | Halter | 272/134 X |
| 3,820,782 | 6/1974 | Salkeld | 272/118 |
| 4,157,089 | 6/1979 | Loughrey | 269/325 X |
| 4,286,782 | 9/1981 | Fuhrhop | 272/134 |
| 4,407,495 | 10/1983 | Wilson | 272/134 X |
| 4,441,706 | 4/1984 | Korzaniewski | 272/134 X |
| 4,564,194 | 1/1986 | Dawson | 272/123 |
| 4,575,077 | 3/1986 | Osborne et al. | 272/123 X |

FOREIGN PATENT DOCUMENTS

| | | | |
|---|---|---|---|
| 2065482 | 7/1981 | United Kingdom | 272/144 |

*Primary Examiner*—Richard J. Apley
*Assistant Examiner*—Robert W. Bahr
*Attorney, Agent, or Firm*—Ronald E. Smith

[57] ABSTRACT

An exercise bench and an exercise tower. Both the bench and the tower have multi-apertured frames so that the respective parts thereof may be adjusted to a plurality of differing functional positions of adjustment and so that the interconnections between bench and tower may also be changed as desired. The bench includes a chair having a seat portion with a back portion hingedly connected thereto. The chair is supported by a carriage member that is slideably adjustable with respect to an elongate central frame member. The exercise tower includes a pair of upstanding frame members and a fixed position support unit that is secured to a wall or other support member to which the upstanding frame members may be secured in an upright position or in different inclined positions. Cables having their respective paths of travel defined by multi-position pulley members interconnect one or two handle members, as the exerciser may select, with weight members so that the exerciser may lift weights by pulling down on the handle or handles in many differing directions. Magnetic locking devices are provided for safety, and a removable bar extending between the upstanding frame members interconnects opposing weights when desired. The bench frame may also be used as a mini-tower, and the tower may be used without cables and pulleys for many exercises. Although the bench and tower may be used independently, they may be interconnected, and their parts exchanged, to provide many additional exercise configurations.

26 Claims, 23 Drawing Figures

FIG_5
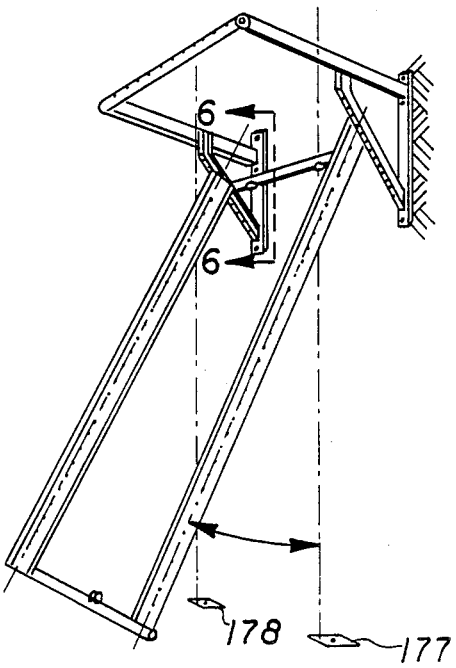
FIG_6
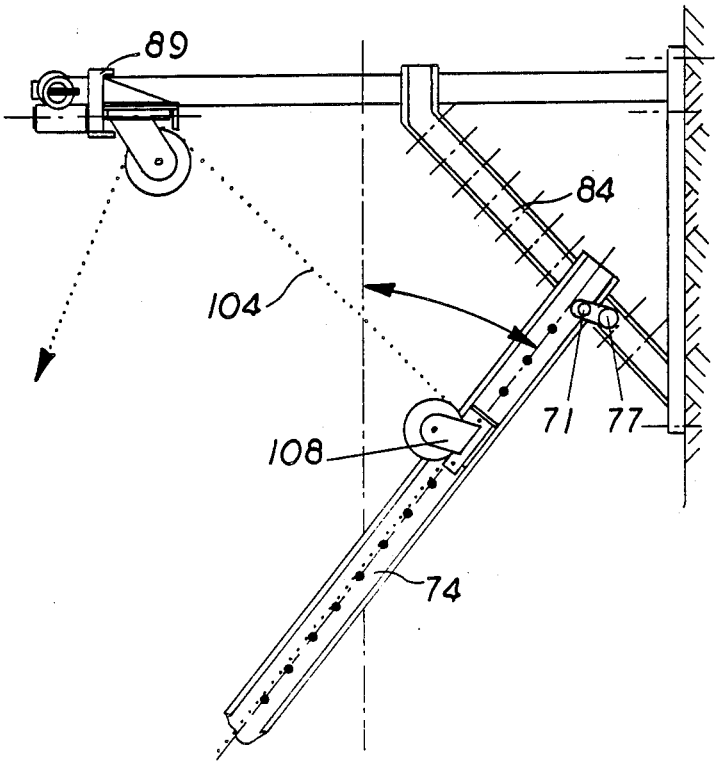
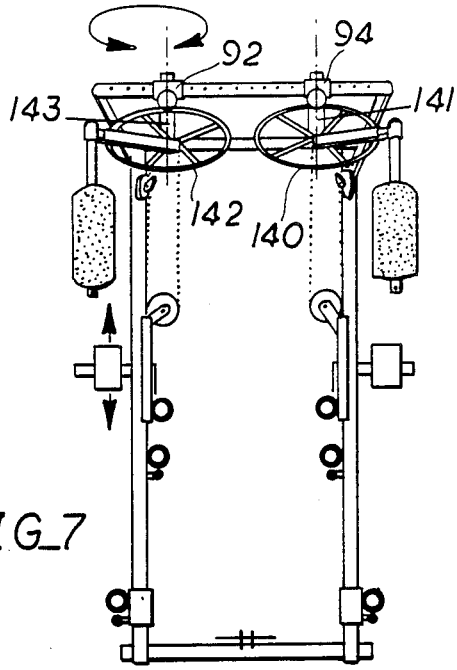
FIG_7
FIG_8
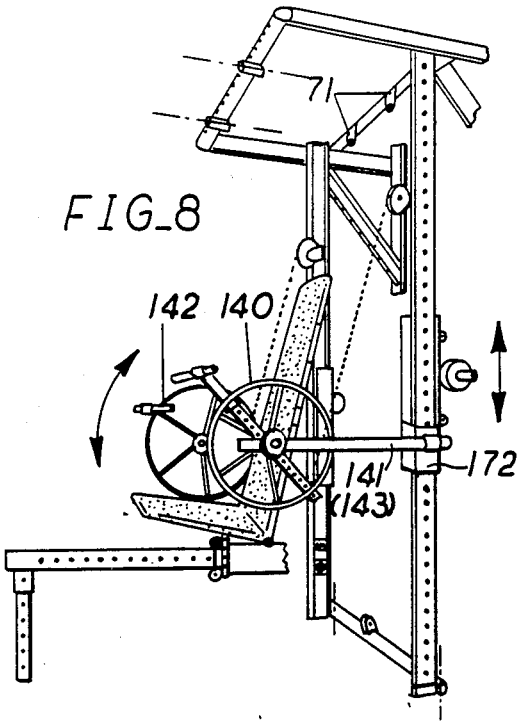

EXERCISE TOWER AND BENCH

BACKGROUND OF THE INVENTION

1. Field of the Invention

This invention relates, generally, to exercise equipment, and more specifically relates to exercise equipment having a bench member that may be used in connection with an upstanding tower member in a plurality of different configurations.

2. Description of the Prior Art

A number of exercise devices that have some similarity to the invention disclosed herein have been patented.

For example, U.S. Pat. No. 3,948,513 to Pfotenbauer (1976) shows an exercise bench that can be positioned in many different positions.

An exercise bench and tower that are connectable to one another and which includes cables and pulleys for lifting weights is shown in U.S. Pat. No. 4,257,590 to Sullivan and others.

Another combination exercise bench and tower having cables and pulleys for lifting weights is shown in U.S. Pat. No. 4,441,706 to Korzaniewski (1984). This patent also discloses the use of multiple apertures in the respective frame members to provide adjustability between the various parts of the device.

The present invention differs in many respects from the devices known heretofore.

The art, though well developed, is still in need of more versatile pieces of equipment.

SUMMARY OF THE INVENTION

The present invention includes a bench member having a pair of laterally spaced upstanding leg members interconnected by a vertically adjustable transversely disposed frame member at one end thereof. A longitudinally disposed central frame member is suspended at one end thereof by the transverse frame member and is supported at its other end by a single leg. A carriage member is rollable and adjustable along the length of the central frame member. A bench chair means, which includes a back portion that is hingedly connected to the seat portion thereof, is releasably secured to such carriage member. The carriage member includes three (3) longitudinally spaced connection points referred to hereinafter as first, second and middle connection points. A first link extends from the first carriage connection point to the back portion of the chair means and a second link extends from the second connection point to be seat portion of the chair means. An intersupport device is connected to either the first or second connection points and the middle connection point. A bolt releasably mounts that part of the chair means where the back and seat portions are hingedly connected to one another to the intersupport device. In this manner, the hinge of the chair means may be positioned by adjusting the intersupport device as desired so that the chair can define an inverted "V" when seen in side elevation, said hinge being at the apex of the "V".

The bench may be used without any leg members to provide a floor level rowing exercise device, for example. This is accomplished by disengaging the carriage member so that it is free to slide relative to the bench frame and by using a horizontal cable pulling arrangement at the tower. The bench may also be used as a mini-exercise tower by removing the chair means and putting the frame of the bench in an upright position. When so used, a pulley is mounted at the top of the bench and a cable rollingly engages the pulley as the cable extends between the carriage and a handle means.

The tower includes a support frame that is permanently secured to a wall or rigid rack at a height sufficient to engage the respective upper ends of a pair of upstanding, laterally spaced frame members. A first pair of supports for swivelly mounted removable pulley members are horizontally adjustable and mounted to a forward cross bar of the support frame. A second pair of laterally spaced, vertically adjustable pulley members are respectively mounted to opposing ones of the upstanding frame members, and a cable is associated with each set of pulleys. One end of each cable is affixed to a handle member that is grasped by the exerciser, and the other end of each cable is affixed to a carriage means. Each carriage means is mounted for vertical adjustment relative to its associated upstanding frame member, and each carriage means includes a horizontally extending bar to which may be added additional weight members. The carriage means may be manipulated individually by the exerciser or a yoking bar may be employed to interconnect them so that the exerciser feels the resistance of the separate weights as a single resistance. The yoking bar is also pivotally mounted so that it may assume an upper or a lower position, depending upon the exercise being performed.

It is an object of this invention to provide a piece of exercise equipment having a high degree of versatility.

Another object is to provide a highly versatile piece of exercise equipment that is constructed of light in weight but strong parts.

Still another object is to provide an exercise device having more than one hundred (100) different exercise configurations.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which:

FIG. 5 is a perspective view showing the tower disposed in one of its inclined positions. Only the parts of the tower essential for the depicted position are shown in this FIG;

FIG. 6 is an elevational view taken along line 6—6 of FIG. 5;

FIG. 7 is a frontal perspective view of the tower equipped with horizontally disposed cable wheel drives mounted to the upper part thereof;

FIG. 8 is a perspective view of the tower equipped with vertically disposed cable wheel drives mounted to the sides of the tower;

Similar reference numerals refer to similar parts throughout the several views of the drawings.

DETAILED DESCRIPTION OF THE PREFERRED EMBODIMENT

Figures 1, 2, 3:
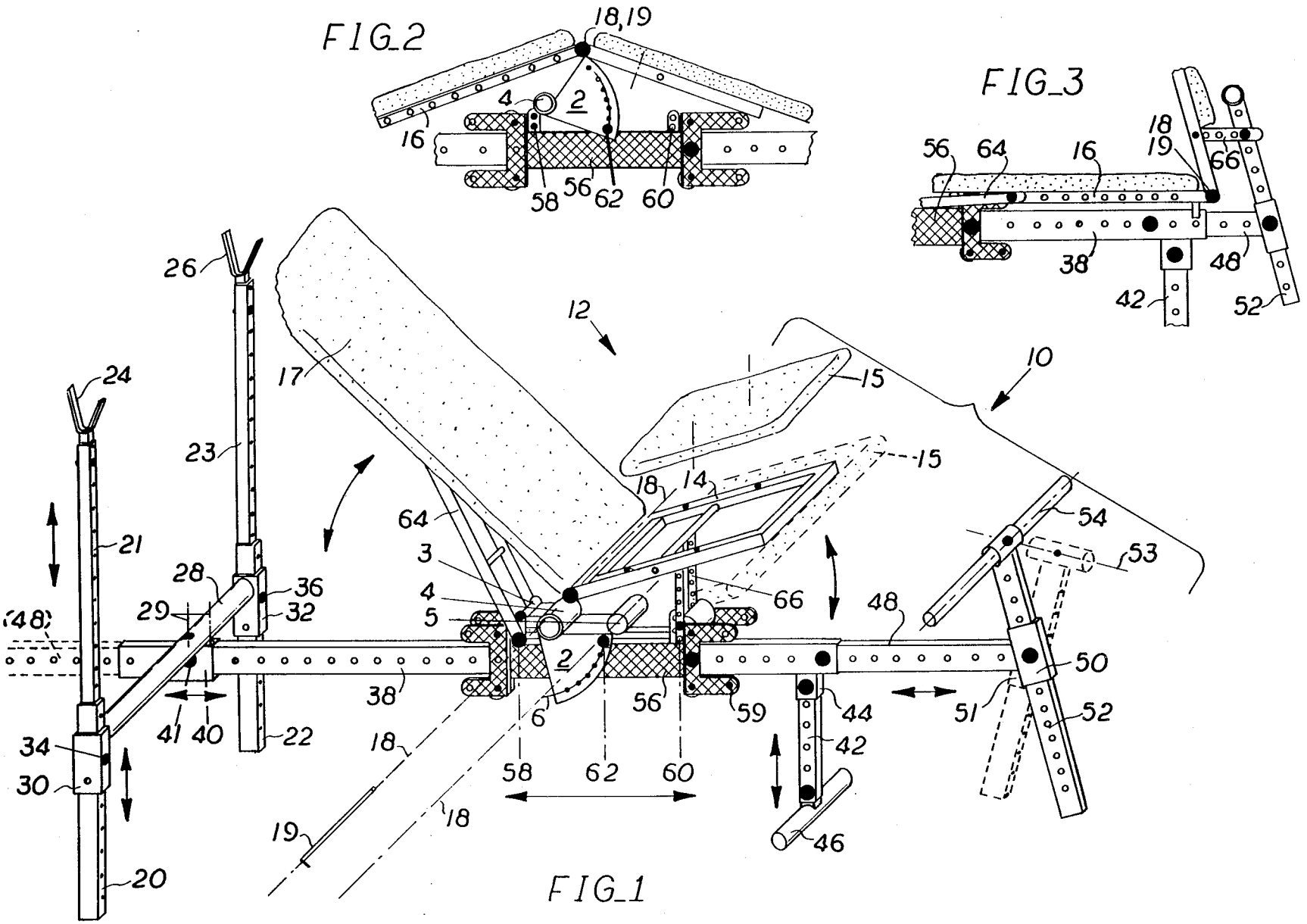
FIG. 1 is a partially exploded perspective view of the novel bench.
FIG. 2 is a side elevational view of the bench carriage member in one of its operative configurations.
FIG. 3 is a side elevational view depicting the chair means of the bench at its forwardmost position with respect to the central frame member of the bench.

Referring now to FIGS. 1–3, it will there be seen that the novel bench is designated by the reference numeral 10 as a whole. The bench 10 includes a chair means 12 which is formed of a seat portion 14 and a back portion 16 that are hingedly connected to one another. Centerline 18 represents the axis of the hinged connection between seat 14 and back 16.

Bench 10 has laterally spaced leg members 20, 22 which telescopically receive leg members 21, 23 which are surmounted by cradle members 24, 26 that support a bar (not shown) of the type commonly employed to rigidly interconnect weight members secured to the opposite ends thereof so that a person lifting the rod must overcome the combined weights of the bar and the weight members.

Cross bar 28 interconnects leg members 20, 22 as shown and is vertically adjustable in that parallelepiped members 30, 32 receive leg members 20, 22 in their respective interiors and may be locked into a desired position through the action of pin members 34, 36. Cross bar 28 is also horizontally adjustable along frame member 38.

Multi-apertured central frame member 38 extends longitudinally perpendicular to cross bar 28 and is suspendedly supported centrally of the cross bar as at 40. Cross bar 28 is lockable with respect to central frame member 38 by means of bolt 41 (of the type shown in FIG. 11 and designated 165) and is held against shaking by jam screws 29 which bear against a jam plate (not shown) disposed interiorly of sleeve 40 which jam plate in turn bears against central frame member 38. The opposite end of central frame 38 is supported by leg 42 which may be telescopically lengenthed or removed from its mount 44 if it is desired to increase or decrease the spacing between the bench and the floor, respectively. Laterally disposed stabilizing rod 46 performs the function its name implies. A horizontally disposed telescopically mounted rod 48 interconnects the free end of central frame 38 and parallelepiped mounting bracket 50 which slideably receives member 52 to which is secured, for example, laterally disposed handle 54 or any other additional parts. Rod 48 may be rotated one hundred eighty (180) degrees with respect to its longitudnal axis so that bracket 50 and hence leg 52 can be positioned in two (2) different positions as indicated generally by the reference numeral 51, the second position of bracket 50 and leg 52 being shown in phantom lines. Leg 52 may also be rotated ninety (90) degrees as indicated at 53 for exercises where additional parts aligned parallel to the longitudinal axis of the bench are needed. All of the parts 48–54 may also be used at the opposite end of the bench for other exercises, as indicated by the phantom lines appearing at the left end of FIG. 1.

A generally paralellepiped carriage member 56 is rollable and lockable along the length of central frame 38 and includes first mounting means 58, second mounting means 60 and middle mounting means 62, which mounting means are equidistantly spaced relative to one another. This equidistant spacing allows the mounting of the intersupport device 2 either on the left or the right part of the carriage member 56 for different exercises.

Four (4) sets of bolt-bridged ears 59 for engaging cable drives are also provided at carriage member 56 as shown.

A rigid link 64 may be connected, e.g., between first mounting means 58 and back portion 16 of chair means 12, and rigid link 66 may be connected between mounting means 60 and seat portion 14 of chair means 12. Rear wall 17 of the seat is permanently secured to its frame 16. Seat cushion 15 is removably mounted to seat frame 14. Moreover, seat cushion 15 may be mounted on seat frame 14 in line with the longitudinal axis of bench 10, or it may be rotated ninety (90) degrees in a horizontal plane. Additionally, seat cushion 15 may also be mounted to the upper side or lower side of seat frame 14 as well. Intersupport device 2 is removably secured to the middle mounting means 62 and one of the mounting means 58 or 60. Intersupport device 2 receives hinge pin 19 which pin hingedly connects intersupport device 2 to seat portion 14 and back portion 16.

Chair means 12 may be mounted to the intersupport device 2 as shown in FIG. 1, or it may be rotated one hundred eighty (180) degrees. Intersupport device 2 has four (4) parts: Pivot-connection 3 which connects it to point 58 or 60, support 4 for carrying additional parts, a hinged point 5 to be connected to parts 14 and 16 and a row of index holes 6 to provide means for attaining variable positions of the intersupport device 2.

FIG. 2 shows that centerline 18 is displaceable due to the adjustment of the intersupport device 2. By removing the bolt from its engagement with the middle connection means 62, lifting the chair means 12 to a desired height and again inserting the bolt at the middle connection means 62, a roof-like arrangement of the chair means 12 is provided for several exercises.

FIG. 3 shows the forwardmost position of chair means 12 with respect to the central frame member 38, which position requires removal of hinge pin 19 from intersupport device 2. In this configuration, chair means 12 is connected to carriage member 56 only by the connection of rigid link 64 and back portion 16.

Figure 4:
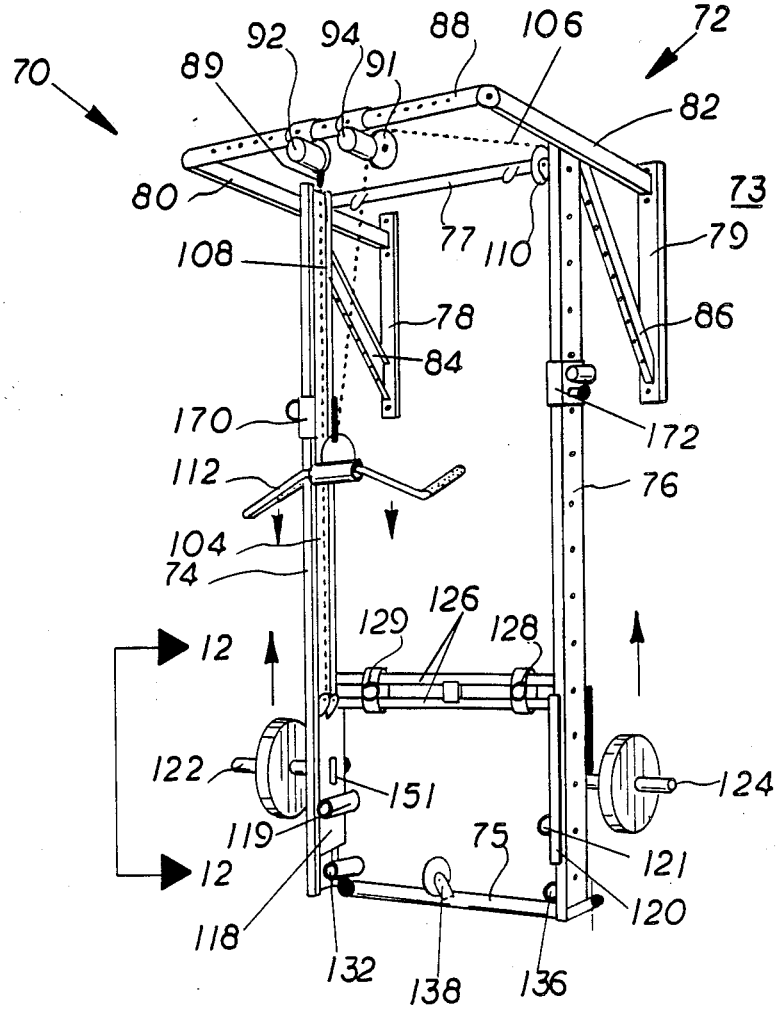
FIG. 4 is a perspective view of the novel exercise tower.

Reference should now be made to FIG. 4 wherein the exercise tower is designated by the reference numeral 70 as a whole. Tower 70 includes a support frame 72 that is fixedly secured to wall 73 and a main tower body that is defined primarily by a pair of upstanding, laterally spaced frame members 74, 76. Frame members 74, 76 are rigidly connected to one another by lower brace member 75 and upper brace member 77. The top of the main tower body is guided in the support frame 72 by the ends of brace member 77, and the lower part of the main tower body is removably mounted to floor plates 177, 178, shown in FIG. 5.

Both the support frame 72 and the floor plates 177, 178 may be mounted to a rigid rack means, not shown, to provide a wall-independent exercise device.

Brace member 75 is provided with a pair of bolt-bridged ears 138 for mounting a cable drive as is well known in the art. Brace member 77 has two (2) ears 71 (FIGS. 6 and 8) for engaging the ends of cable drives when pulleys are used as in the example of FIG. 7.

The support frame 72 includes wall mounting plates 78, 79, cantilevered arms 80, 82 extending outwardly therefrom in a horizontal plane, brace members 84, 86, which brace members are also guiding supports for the tower body when it is inclined from the vertical, and a circular in section cross bar 88 that interconnects the free ends of cantilevered arms 80, 82 and which carries the horizontally disposed, rotatable support members 92, 94 which are provided for additional parts.

Figure 11:
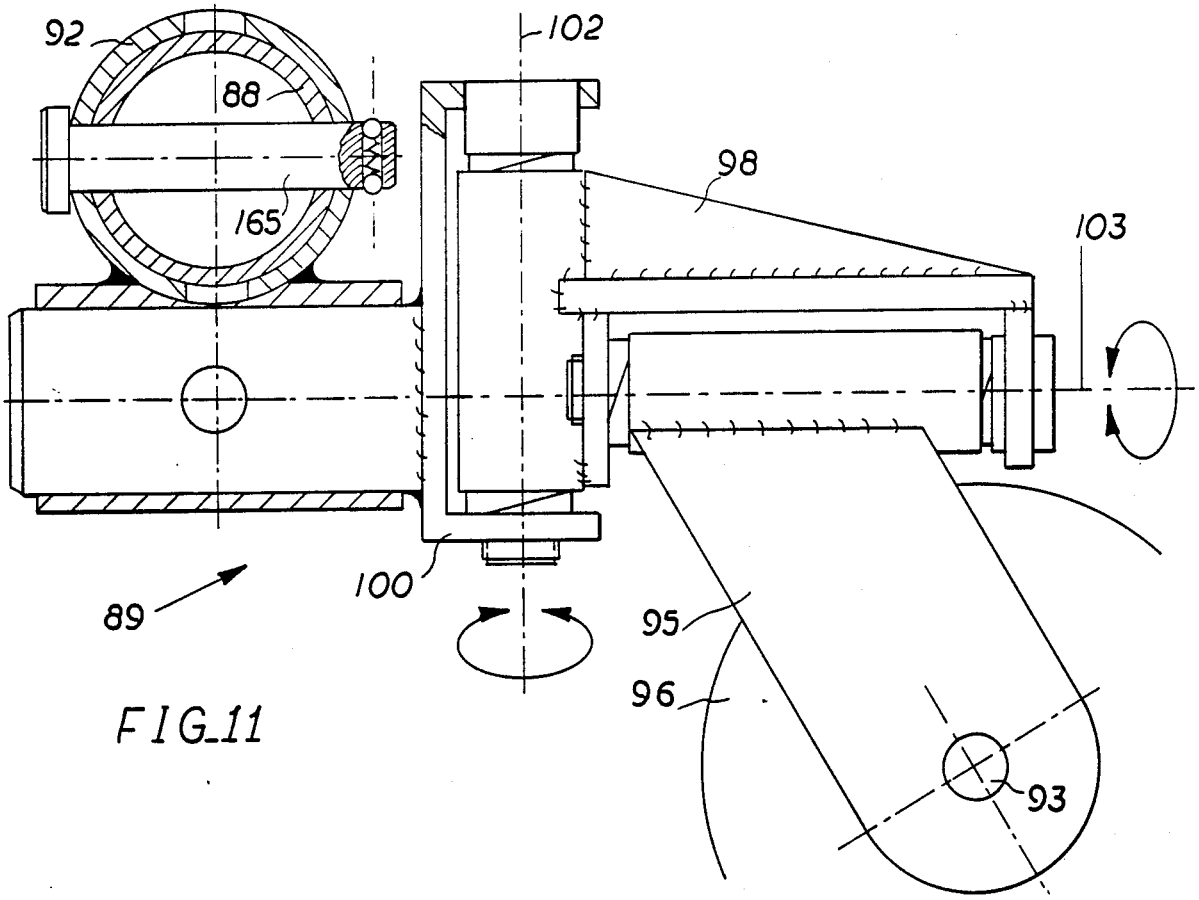
FIG. 11 is a detailed, partially sectional, side elevational view of a double axled pulley support.

A pair of identical (mirror image) pulley members 89, 91 are removably mounted on cross bar 88 by means of supports 92, 94. As shown in FIG. 11, wherein cross bar 88 is shown in transverse section, pulley 96 is rotatably mounted about pin 93 on a mounting ear denoted 95. A swivel mount for the pulley is provided by brackets 98 and 100. By rotating the pulley around axes 102 and 103, any three-dimensional direction of the cable is provided. The pulley members 89, 91 may also be employed at a set of rods 190, 192, 194 (FIG. 21) inserted in the supports 170, 172 to provide cable turning points for special exercises. For this purpose rod 194 is lengthened by additional lengthening rods (not shown) and the pulley members 89, 91 are removably mounted at (lengthened) rod 194 by means of additional supports (not shown) that are very similar to supports 92, 94.

Figures 17, 18:
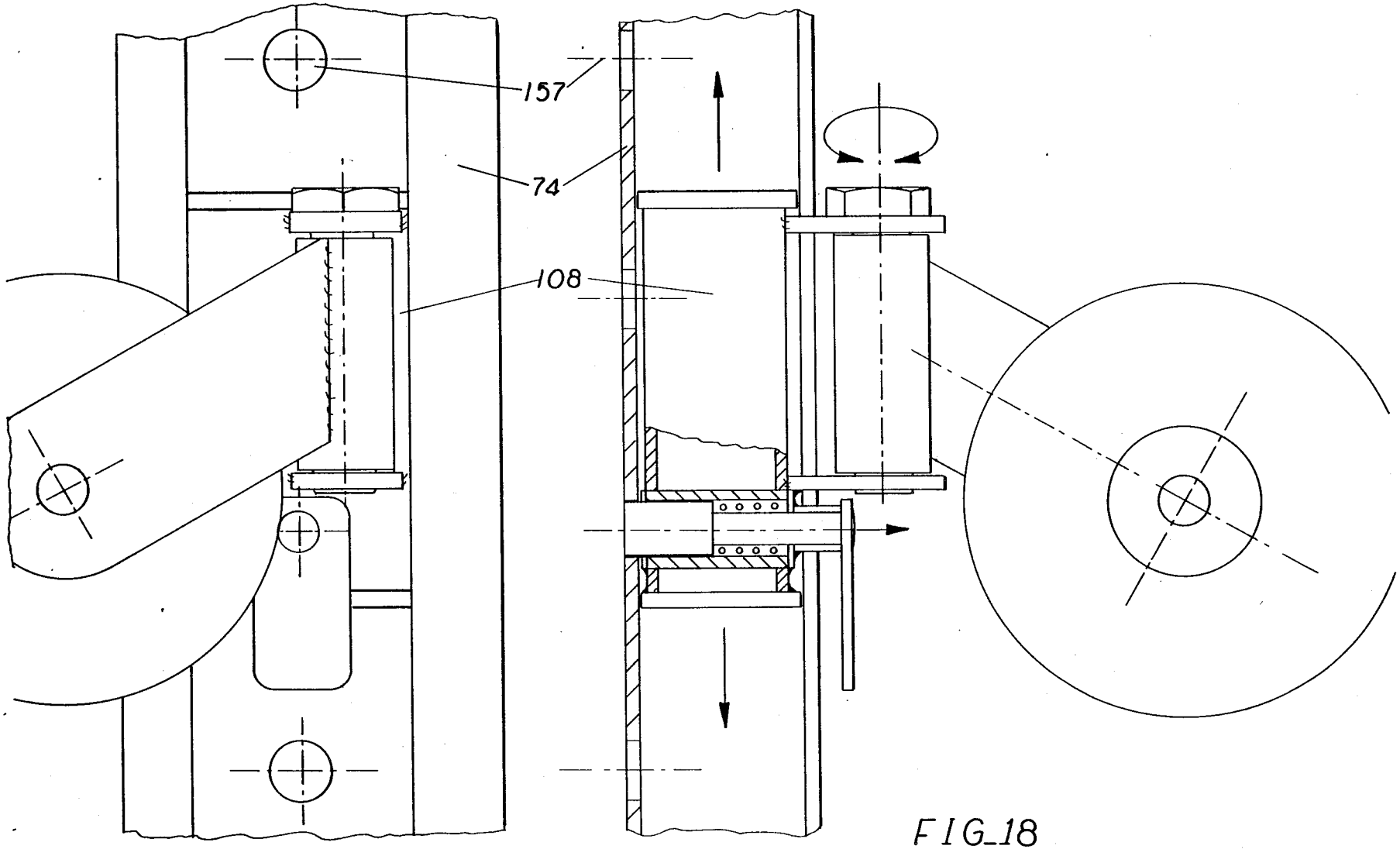
FIG. 17 is a side elevational view that depicts one of the vertically adjustable pulleys.
FIG. 18 is a side elevational view that depicts the pulley of FIG. 17 rotated ninety (90) degrees.

Elongate cable members 104, 106 are deployed in the respective grooves of pulleys 89, 91 at support 92, 94 and also in the respective grooves of pulleys 108, 110. Pulleys 108, 110 are vertically adjustable with respect to their respective frame members 74, 76, as suggested by FIGS. 17 and 18. A first end of each cable 104, 106 is removably secured to handle bar 112. Any other conventional handle bar may also be used. A second end of each cable 104, 106 is removably secured to the mirror image carriages 118, 120. Weight means 122, 124 extend laterally from carriages 118, 120, respectively, and provide mounting means to which may be added conventional, centrally apertured weight members. In this manner, the exerciser may pull down on handle bar 112 and lift carriages 118, 120 alone, or additional weights if desired, for example.

Figure 12:
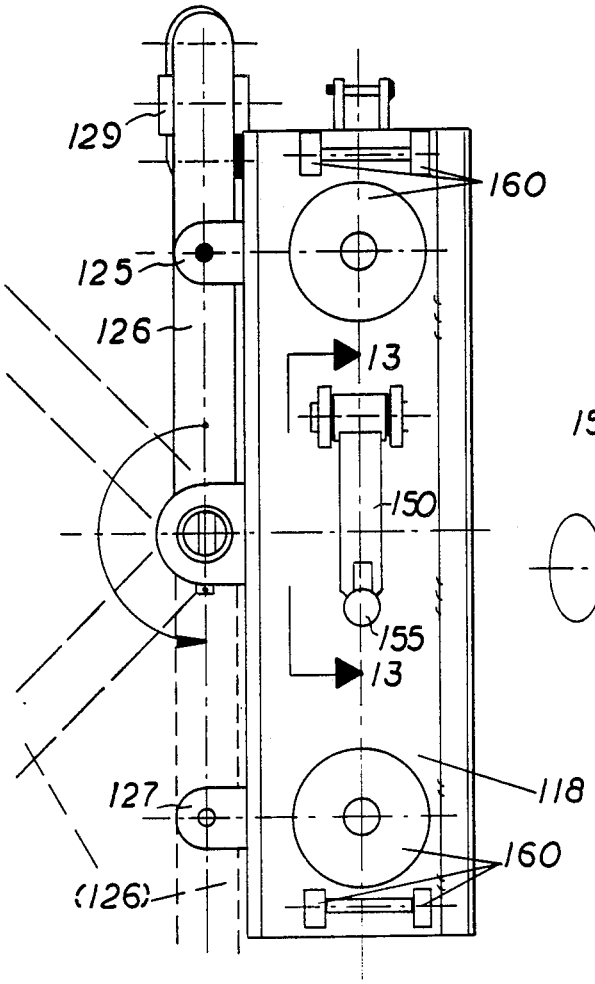
FIG. 12 is a side elevational view taken along line 12—12 of FIG. 4, with the frame member being omitted to simplify the drawing.

Carriages 118, 120 are yoked together by yoking bar 126 which extends therebetween. It may assume two (2) different positions as shown in FIG. 12. Yoking bar 126 is locked at its upper and lower portion by means of the bolt-bridged locking supports 125, 127, respectively. Yoking bar 126 may be removed from tower 70, which renders the carriages 118, 120 separate units so that the exerciser may exercise the muscles on one side of the body independently of the other if desired.

Figure 21:
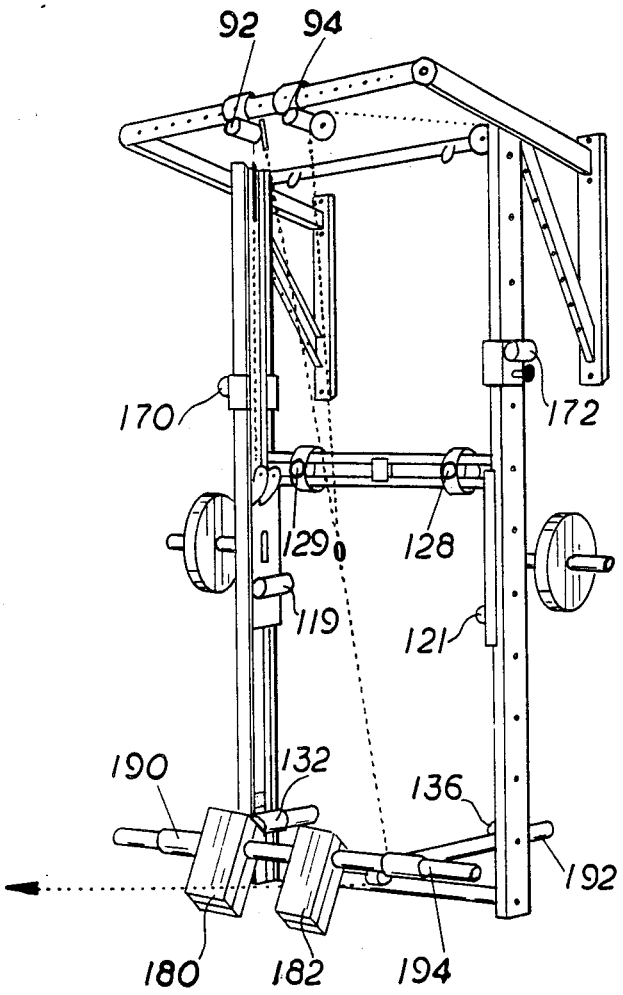
FIG. 21 is a perspective view of the tower equipped with a set of rods. In the configuration shown, the rods are inserted into the supports of the catch device forming a support arrangment for the pedals. Moreover, this FIG. illustrates other supports for the rods and other parts of the novel device as well.

Weight means 122, 124 serve to connect yoking bar 126 to carriages 118, 120. Yoking bar 126 contains two horizontally adjustable supports 128, 129 for additional parts such as a set of rods 190, 192, 194, as shown in FIG. 21, (for lifting weights without cable drives) or connection bars (not shown) for carrying seat means when using a human body as a load, for example.

Carriages 118, 120 contain additional supports 119, 121 for additional parts such as weight-carrying means. In this case weight means 122, 124 may be removed and used as weight means in these supports 119, 121. Supports 119, 121 allow the use of heavy loads without having undersired torque forces and friction inside the carriages 118, 120 when yoking bar 126 is removed.

Carriages 118, 120 are disposed outside the frame members 74, 76, but their guiding sets of wheels 160 are disposed inside said frame members 74, 76.

Figure 13:
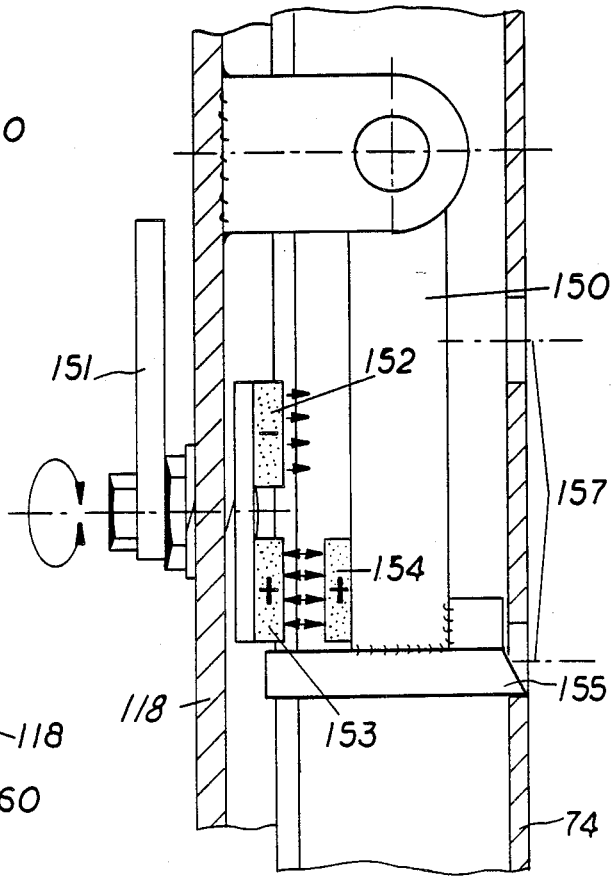
FIG. 13 is a detailed, enlarged view taken along line 13—13 in FIG. 12 showing the magnetic safety device of the present invention.

Carriages 118, 120 are equipped with magnetic safety locking devices as shown in FIGS. 12 and 13. Levers 151 (only one of which is visible in FIG. 13), when in their respective upright positions (as shown in FIG. 13) aligns positive magnets 153, 154 and the repulsive force drives locking pin 155 of the locking device 150 into index hole 157 which is formed in the frame as shown.

Carriages 118, 120 can be lifted, but not lowered, when the positive magnets are aligned and will maintain their highest position.

Levers 151, in their respective downward positions, align negative magnet 152 and positive magnet 154. Thus, when the carriages 118, 120 are lifted slightly, the locking devices 150, 155 are retracted by the attractive force from index holes 157 in frame members 74, 76 and kept inside the carriages 118, 120. The carriages 118, 120 are then ready to be used.

By means of the levers 151 the magnetic system serves also as a safety device in case of emergency while exercising, since such system is effective to unload the exerciser in any position.

Figure 20:
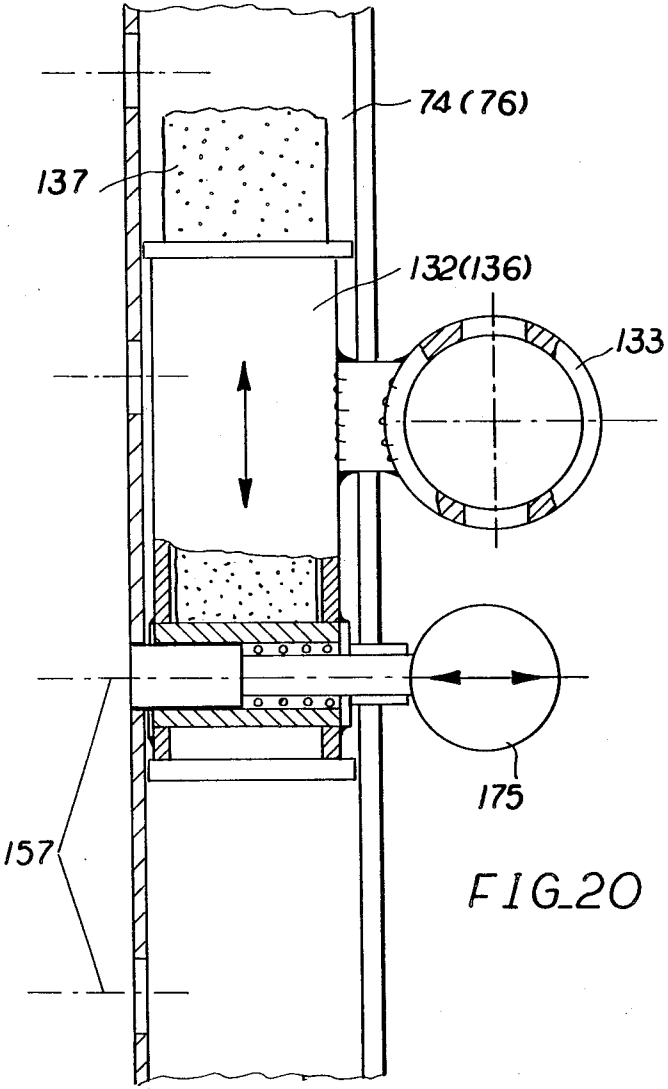
FIG. 20 is a partially cross sectional side elevational view of a safety catch device which is disposed interiorly of the frame of the tower.

For additional safety and comfort purposes vertically adjustable catch devices 132, 136 (FIGS. 4 and 20) are provided inside the frame members 74, 76 to limit the travel of the carriages 118, 120.

Both safety-systems allow heavy and dangerous exercises to be performed in the absence of an assistant.

The catch devices 132, 136 (FIG. 20) are equipped with rubber cores 137 to catch the carriages 118, 120 smoothly and silently. The catch devices 132, 136 also have additional supports 133 for additional parts, such as a set of rods 190, 192, 194 (FIG. 10) as counter parts for the feet of a cable-pulling exerciser.

Figure 10:
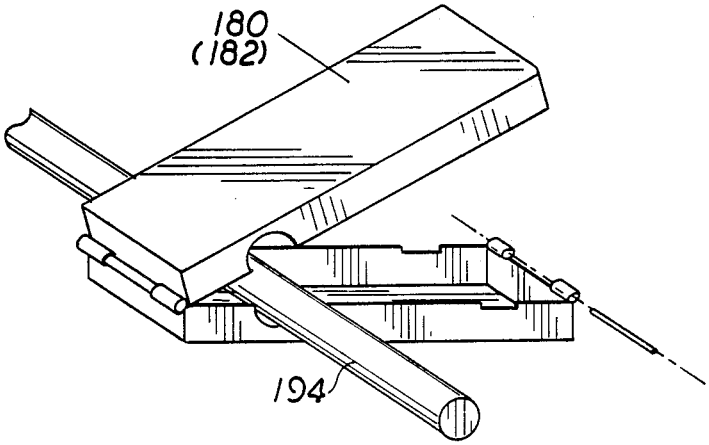
FIG. 10 is a perspective view of the versatile pedals of the subject invention.

The tower is equipped with a set of 2 hollow pedals 180, 182 (FIG. 10). These pedals may be used on a set of rods 190, 192, 194 (FIG. 21) either mounted to the frame parts 74, 76 (by means of supports 132, 136 or 170, 172) or to the lifting parts 118, 120, 126 (by means of supports 119, 121 or 128, 129). Mounted the first way the pedals serve as bearing surfaces for the feet of the cable-pulling user. Mounted the second way the pedals serve as power input plates when weight is to be lifted with the feet. The third purpose of the pedals is their use as independent weight-shoes by means of a set of belts (not shown). In this case the inside of the pedals may be loaded with additional weights or the pedals may be equipped with rods carrying the well known exercise weights.

Figure 16:
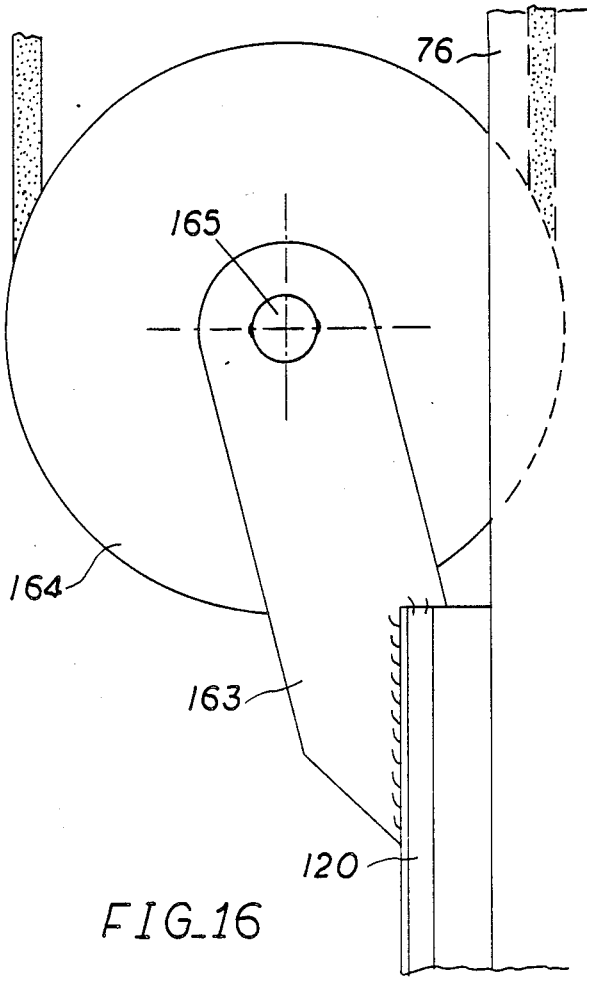
FIG. 16 is a side elevational view of the upper part of a tower carriage showing the arrangement of a pulley cable drive.
Figure 15A:
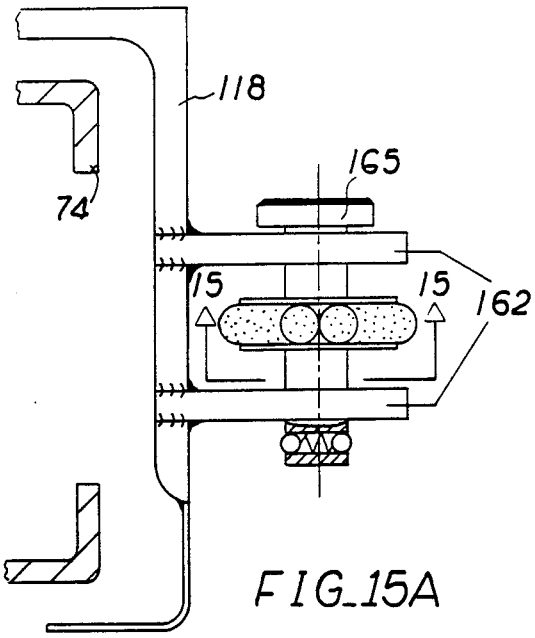
FIG. 15A is a partially cross sectional view taken along line 15A—15A of FIG. 15.
Figure 16A:
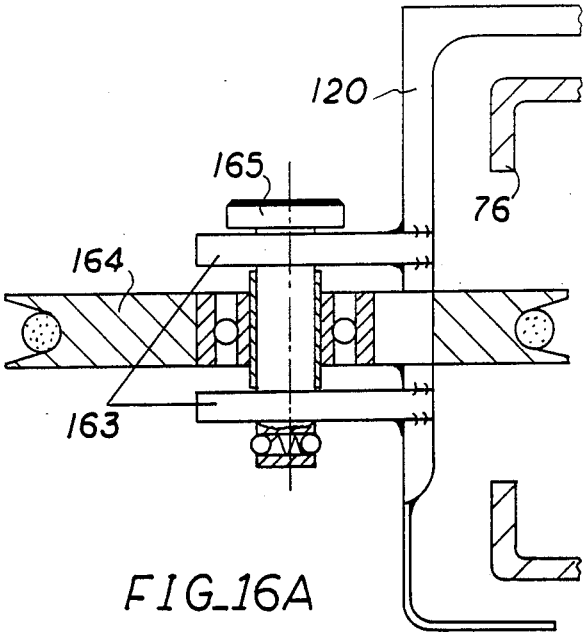
FIG. 16A is a partially cross sectional top plan view of the parts shown in FIG. 16.

Carriages 118, 120 are equipped with bolt-bridged supports 162, 163 shown in FIGS. 15, 15A, 16 and 16A which are designed for employing single cable drives by means of bolt 165 (FIG. 15) or power-saving pulley drives by means of bolt 165 and pulley 164 (FIG. 16).

Figure 14:
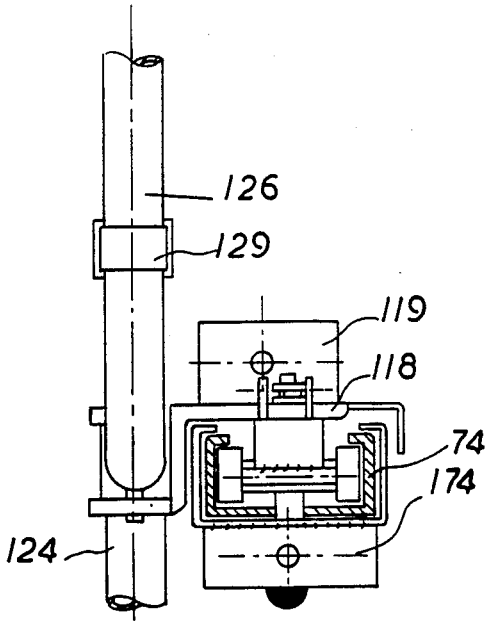
FIG. 14 is a partially cross sectional plan view of the tower portion shown in FIG. 12.
Figure 15:
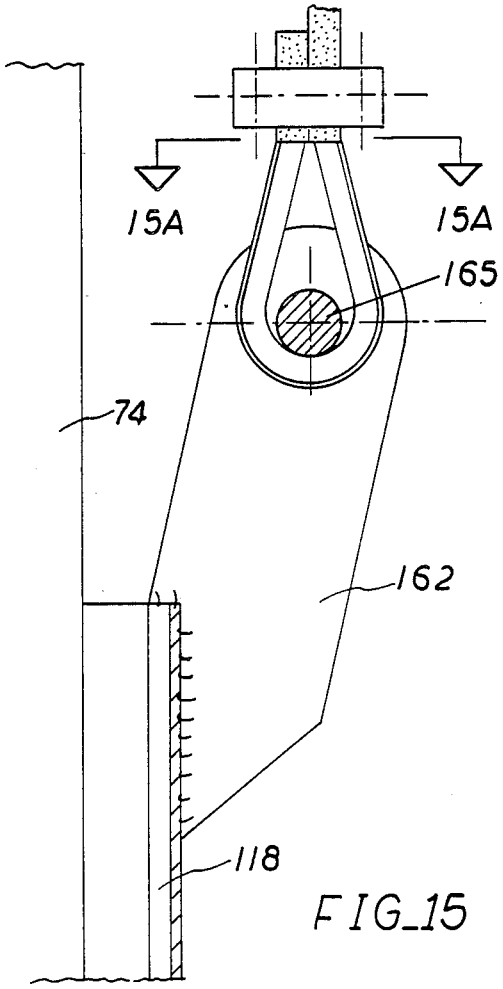
FIG. 15 is a side elevational, partially sectional view of an upper part of a tower carriage showing the engagement of a single cable drive.
Figure 19:
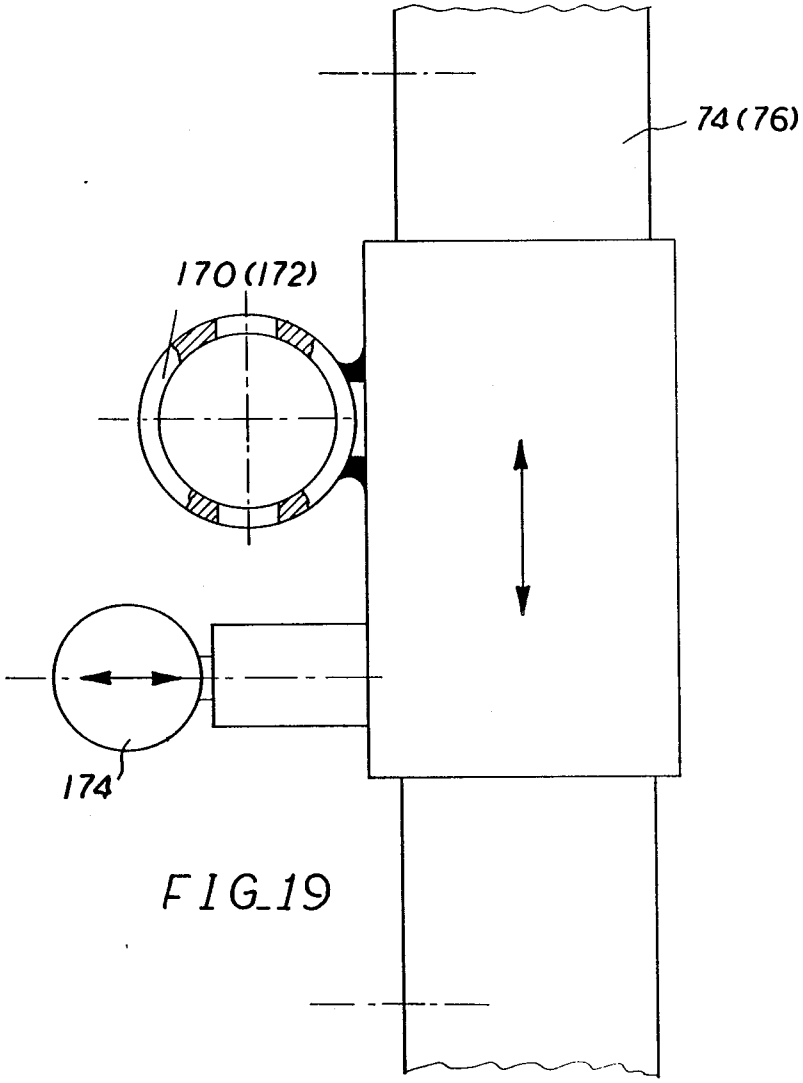
FIG. 19 is a side elevational view of a vertically adjustable outer support which is provided for additional parts, shown relative to a frame portion of the tower.

The tower 70 is equipped with vertically adjustable outer supports 170, 172 as shown in FIGS. 4 and 19. These supports 170, 172 do not interfere with the movement of the carriages 118, 120 or the movement of the catch devices 132, 136 or with the movement of the pulley supports 108, 110 (see also FIG. 14).

Supports 170, 172 and 132, 136 and 108, 110 remain mounted on the frame members 74, 76 at all times. They may be vertically adjusted simply by pulling knob 174 (FIG. 19), or 175 (FIG. 20), respectively, shifting the support and releasing the knob.

Tower 70 may also be equipped with an additional set of two (2) mirror image cable wheels 140, 142 (FIGS. 7, 8) for additional exercises. The cable wheels may be mounted to special wheel supports 141, 143 (FIG. 7 and 8) or their hubs may be mounted without the supports 141, 143 to any suitable rod.

The cable wheels may be vertically mounted to supports 170, 172 (FIG. 8) or horizontally to the turned supports 92, 94 (FIG.7) to provide additional exercise configurations. When the cable wheel drives are used, the cable ends are removably engaged to a desired spoke of the cable wheel, as shown in FIG. 8.

Figure 9:
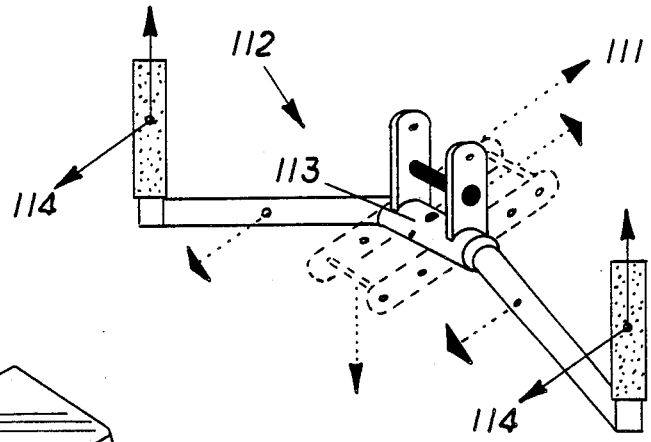
FIG. 9 is a perspective view of the versatile handle of the tower.

The tower 70 is also equipped with a versatile handle 112 as shown in FIG. 9. The handle 112 is equipped with a rotatable and lockable hub (113). This allows the user of the equipment to adjust the cable fixing point 111 so that it is in alignment with the power input points 114 of the user's hands to thereby avoid any undesired torque in the handle system during any exercise.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, that which is claimed is:

1. An exercise device that includes a bench and a tower which bench and tower maybe interconnected to one another and used as a single exercise device or which may be detached from one another and used as independent exercise devices, comprising:

a bench means;

a tower means;

said bench means including a horizontally disposed elongate central frame member;

a bench carriage means rollably mounted to said central frame member;

a chair means;

said chair means including a back portion and a seat portion hingedly connected together;

said bench carriage means having a first, second and third chair mounting means;

a first rigid link member for removably interconnecting said back portion of said chair means to said first or third chair mounting means;

a second rigid link member for removably interconnecting said seat portion of said chair means to said first or third chair mounting means;

an intersupport device generally triangular in configuration, said intersupport device including a plurality of generally linearly but slightly arcuately arrayed aperture means formed therein between a first and second preselected corner thereof, and a central bore means proximate a third corner of said intersupport device;

a hinge pin means for hingedly interconnecting said back and seat portions of said chair means, said hinge pin means being received by an aperture means adjacent one of said first or second corners of said intersupport device;

said central bore means of said intersupport device being detachably mounted to said first or third chair mounting means;

and said intersupport device being selectively attachable to said second chair mounting means through said aperture means to provide differing angles of adjustment between said back and seat portions of said chair means, including angles of adjustment greater than one hundred eighty degrees.

2. The exercise device of claim 1, wherein said chair means is selectively mountable to said bench carriage means or to said intersupport device.

3. The exercise device of claim 2, wherein said bench carriage means is rollable and selectively lockable into any preselected position along the length of said central frame member.

4. The exercise device of claim 3, wherein said central frame member is telescopically engaged by a rod member that lengthens the effective length of said central frame member when extended from either end of said central frame member.

5. The exercise device of claim 4, wherein a generally upstanding arm member is releasably engaged by a distal free end of said rod member, and wherein said arm member is tiltable either toward or away from said rod member depending upon the engagement established between said arm member and said rod member.

6. The exercise device of claim 5, wherein a first end of said central frame member is suspendedly engaged by a horizontally adjustable support means, and wherein a second end of said central frame member is supportedly engaged by an upstanding leg member, and wherein said upstanding leg member has a laterally disposed stabilizing bar at its lowermost end to stabilize said central frame member against lateral rocking.

7. The exercise device of claim 1, wherein said tower means further comprises a fixed position upper portion that includes a pair of laterally spaced wall mounting plates, a pair of cantilevered arms extending outwardly therefrom, a pair of brace members extending in supporting relation between said respective wall mounting plates and said cantilevered arms, and a cross bar member disposed in interconnecting relation to the free ends of said cantilevered arms.

8. The exercise device of claim 7, wherein said tower means further comprises a main tower body that includes a pair of parallel, laterally spaced frame members the upper ends of which are releasably connectable to said brace members in a plurality of differing positions including upright positions and positions wherein said frame members are inclined toward said wall mounting plates.

9. The exercise device of claim 8, wherein a pair of pulley members are horizontally adjustable and removably mounted to said cross bar member, and wherein said pulley members are pivotal about a horizontal axis and about a vertical axis.

10. The exercise device of claim 9, wherein a pair of pulley members are movable in a plurality of differing positions of vertical adjustment relative to said frame members and swivelly mounted about a vertical axis, there being one of said pair mounted on each of said frame members, said movable mounting providing for vertical adjustment of said pulley members and said swivelable mounting providing for movement of said pulley members about a vertical axis.

11. The exercise device of claim 10, further comprising a pair of tower carriage members, each member of the pair being mounted for vertical movement with respect to one of said frame members.

12. The exercise device of claim 11, further comprising an elongate handle member having hand grips at its opposed ends, said handle member having a hub portion mounted for rotation relative to the elongate handle member, which hub portion is lockable at different positions.

13. The exercise device of claim 11, further comprising a pair of cable means wherein each member of the pair of cable means has a first end removably secured to an associated tower carriage member, and a second end thereof removably secured to said handle member.

14. The exercise device of claim 13, wherein said cable means rollingly engage said cross bar pulley members when extended between said handle member and said tower carriage members.

15. The exercise device of claim 14, wherein said tower carriage members are provided with laterally extending weight mounting means to which can be added weight members to increase the weight that must be lifted by an exerciser attempting to raise said tower carriage members as by pulling on said handle member.

16. The exercise device of claim 15, further comprising a yoking bar means that releasably interconnects said tower carriage members so that the exerciser must overcome the weight of both tower carriage members in order to displace the same when they are yoked together by said yoking bar means and where the exerciser may remove said yoking bar means when it is desired to perform an exercise that requires overcoming the respective weights of said tower carriage members independently of one another.

17. The exercise device of claim 16, wherein said yoking bar means is pivotally mounted and has a first upper position and a second lower position, and wherein means are provided to lock said yoking bar means in either its upper or lower positions.

18. The exercise device of claim 17, further comprising a safety means that prevents said tower carriage members from falling when an exerciser indirectly releases the same by releasing said handle member, said safety means including magnets of opposite polarity which use the attraction force established by their alignment to displace a pair of safety latch members so that each member of the pair engages a slot formed in said respective frame members which engagement prevents vertical travel of said tower carriage members, and said safety device further including magnets of opposite polarity which use the repulsive force established by their alignment to pull said safety latch members out of their respective slots to release said tower carriage members for vertical travel with respect to said frame members.

19. The exercise device of claim 18, further comprising a pair of cable wheel members of large diameter relative to the diameters of all of said pulley members, each member of said pair of said cable wheel members being mountable to a different one of said tower frame members in a vertical plane or each member of said pair of cable wheel members being mounted in a horizontal plane to different ones of said cross bar pulley members.

20. The exercise device of claim 19, further comprising a pair of hollow pedal members and further comprising a plurality of interconnectable rod members releasably connectable to said frame members to one of which rod members said pedal members may be mounted.

21. The exercise device of claim 20, wherein said frame members are interconnected at their respective upper and lower ends by a pair of laterally disposed brace members.

22. The exercise device of claim 21, wherein a pulley member is mounted mid-length of said lower laterally disposed brace member.

23. The exercise device of claim 22, further comprising a pair of tower carriage member catching devices having rubber cores wherein each member of said pair of catch devices is vertically and adjustably mounted to a different one of said frame members at the lowermost respective end thereof.

24. The exercise device of claim 18, wherein said alignment of said magnets is established by lever means the position of which is selectable by the exerciser.

25. The exercise device of claim 1, further comprising a generally rectangular in configuration seat cushion which is removably mounted to a seat frame, wherein said seat cushion may be mounted to said frame in line with a longitudinal axis of said bench means or wherein said seat cushion may be rotated ninety degrees from such aforesaid position, and wherein said seat cushion may be selectively mounted to a top or bottom side of said seat frame.

26. The exercise device of claim 16, further comprising a pair of laterally spaced adjustable support members which are positioned on said yoking bar means said adjustable support members adapted to support connection bars to support said seat portion or other parts such as a set of rods.

* * * * *